US005333631A

United States Patent [19]

Kirkland et al.

[11] Patent Number: 5,333,631

[45] Date of Patent: Aug. 2, 1994

[54] CLEANING WASH-ARM FOR DISHWASHING FILTER

[75] Inventors: Daniel R. Kirkland, Winterville, N.C.; Mark A. Sublette, Columbus, Ind.

[73] Assignee: White Consolidated Industries, Inc., Cleveland, Ohio

[21] Appl. No.: 56,996

[22] Filed: May 4, 1993

[51] Int. Cl.[5] ..... A47L 15/23

[52] U.S. Cl. ..... 134/104.1; 134/111; 134/179

[58] Field of Search ..... 134/104.1, 111, 179

[56] References Cited

U.S. PATENT DOCUMENTS

| | | | |
|---|---|---|---|
| 3,575,185 | 4/1971 | Barbulesco | 134/111 X |
| 3,809,106 | 5/1974 | Crabtree | 134/176 |
| 3,951,684 | 4/1976 | LaPrad et al. | 134/144 |
| 4,038,103 | 7/1977 | Grunewald | 134/111 X |
| 4,346,723 | 8/1982 | Geiger | 134/186 X |
| 4,392,891 | 7/1983 | Meyers | 134/111 X |
| 4,418,868 | 12/1983 | Gurubatham et al. | 239/228 |
| 4,468,333 | 8/1984 | Geiger | 210/798 |
| 4,559,959 | 12/1985 | Meyers | 134/56 D |
| 4,673,441 | 6/1987 | Mayers | 134/18 |
| 4,972,861 | 11/1990 | Milocco et al. | 134/104.1 |
| 5,165,433 | 11/1992 | Meyers | 134/111 X |
| 5,165,435 | 11/1992 | Thies et al. | 134/181 |

FOREIGN PATENT DOCUMENTS 2204482 11/1988 United Kingdom .

*Primary Examiner*—Philip R. Coe

*Attorney, Agent, or Firm*—Pearne, Gordon, McCoy & Granger

[57] ABSTRACT

The present invention provides a wash arm for a dishwasher which includes first and second openings which simultaneously propel the wash arm and rinse or backflush filtered debris from a filter. The filter includes a settling chamber and a mesh screen, the mesh screen defining a portion of the top surface of the settling chamber and including inner and outer surfaces. Wash water flows through the mesh screen from the inner surface to the outer surface, causing filtered debris to be retained or trapped on the inner surface of the filter. The openings in the wash arm are downwardly and outwardly directed, and supply rinsing jets of wash water which impinge upon the outer surface of the filter and rinse retained debris from the inner surface thereof. The rinsed debris is thereafter held and suspended within the settling chamber until the dishwasher is drained. The pair of openings are radially displaced first and second distances from a center of the wash arm. Reaction forces produced by water exiting the openings combine or cooperate, resulting in a net reaction force which rotatably drives the wash arm about its axis of rotation at a predetermined rate.

20 Claims, 3 Drawing Sheets

CLEANING WASH-ARM FOR DISHWASHING FILTER

BACKGROUND OF THE INVENTION

1. Field of the Invention

The present invention generally pertains to dishwasher wash arms of the rotatable type and, more particularly, to wash arms which supply a cleaning spray to a dishwasher filter.

2. Description of the Related Art

During the development of dishwashing machines, it has been common to include strategically located holes in the wash arm to supply a dish-cleaning spray to dishes or the like within the machine. It has also been common for the wash arm to include additional holes which perform a wash arm propelling function. The dish-cleaning spray is typically provided by a series of holes on the upper surface of the wash arm which are generally aimed towards the dishes to be cleaned. The propelling function is typically provided by holes at opposite terminal ends of the wash arm which are advantageously located and sized to control the rotational speed of the wash arm.

It has been proposed to orient the openings in the upper surface of the wash arm such that the propelling and dish cleaning functions are simultaneously provided thereby. U.S. Pat. No. 3,809,106, which discloses an upper wash arm including a plurality of upwardly and downwardly directed spray openings, is exemplary of wash arms of this type. The openings are arranged to provide sufficient rotational motion to the wash arm and thereby simultaneously provide both the dish washing function and the wash arm propelling function. See also, U.S. Pat. No. 3,951,684.

In recent times, wash arms have been further developed to include openings which direct a spray of wash water toward a filter to thereby rinse debris from the filter. U.S. Pat. No. 4,038,103 is illustrative of this type of wash arm. In the '103 patent, wash water from the sump is drawn through a vertically-oriented filter. Debris is filtered from wash water as it flows through the filter. Filtered debris is retained on the exterior surface of the filter. Water emanating from an opening in the wash arm impinges upon the exterior surface of the filter at an acute angle, thereby washing the filtered debris down into the sump where it will be drained from the machine at the end of the wash cycle.

A comparable filter-cleaning wash arm is disclosed in British Patent No. 2,204,482 wherein separate openings simultaneously rinse fine and course filters. The wash arm of the '482 patent produces three rinsing jets, two of which tangentially strike or impinge upon the fine filter and wash debris therefrom, while the remaining rinsing jet perpendicularly impinges upon the coarse filter. A related filtering scheme is disclosed in U.S. Pat. No. 4,972,861.

U.S. Pat. Nos. 4,392,891; 4,559,959; and 4,673,441 disclose wash arms which provide spray openings to direct a rinsing spray to impinge upon and, in effect, back-flush a filter. The filter removes debris from wash water flowing therethrough, and retains the filtered debris on an inner surface thereof. The openings in the wash arm spray wash water onto an outer surface of the filter. The filtered debris is retained within a chamber, and later drained therefrom. See also, U.S. Pat. No. 3,575,185 wherein a portion of the water to the wash arm is diverted to rinse or back flush a vertically-oriented filter.

SUMMARY OF THE INVENTION

The present invention provides a wash arm having combined wash arm propelling and filter rinsing means. The propelling and rinsing means includes first and second downwardly and outwardly directed openings.

In accordance with the present invention, the first opening is radially spaced from a center of the wash arm a greater distance than the second opening. Water projecting from the first and second openings creates a net reaction force which rotatably drives the wash arm about its generally vertical axis of rotation.

In further accordance with the present invention, the wash arm is used in conjunction with a wash water filter. The filter underlies the wash arm and provides a mesh portion having inner and outer surfaces. Wash water flows through the filter from an inner surface to an outer surface thereof. Debris is filtered from the wash water by the mesh portion and retained on the inner surface of the filter. Water projecting from the first and second openings rinses the retained debris from the filter.

The wash arm provides a flow-directing cover member around each of the first and second openings. The cover members direct water so that it outwardly and downwardly emanates or projects from the wash arm, creating a fan-like spray of filter-rinsing water which rotatably propels the wash arm about its axis of rotation.

BRIEF DESCRIPTION OF THE DRAWINGS

These and further features of the present invention will be apparent with reference to the following description and drawings, wherein.

DETAILED DESCRIPTION OF THE PREFERRED EMBODIMENT

Figure 1:
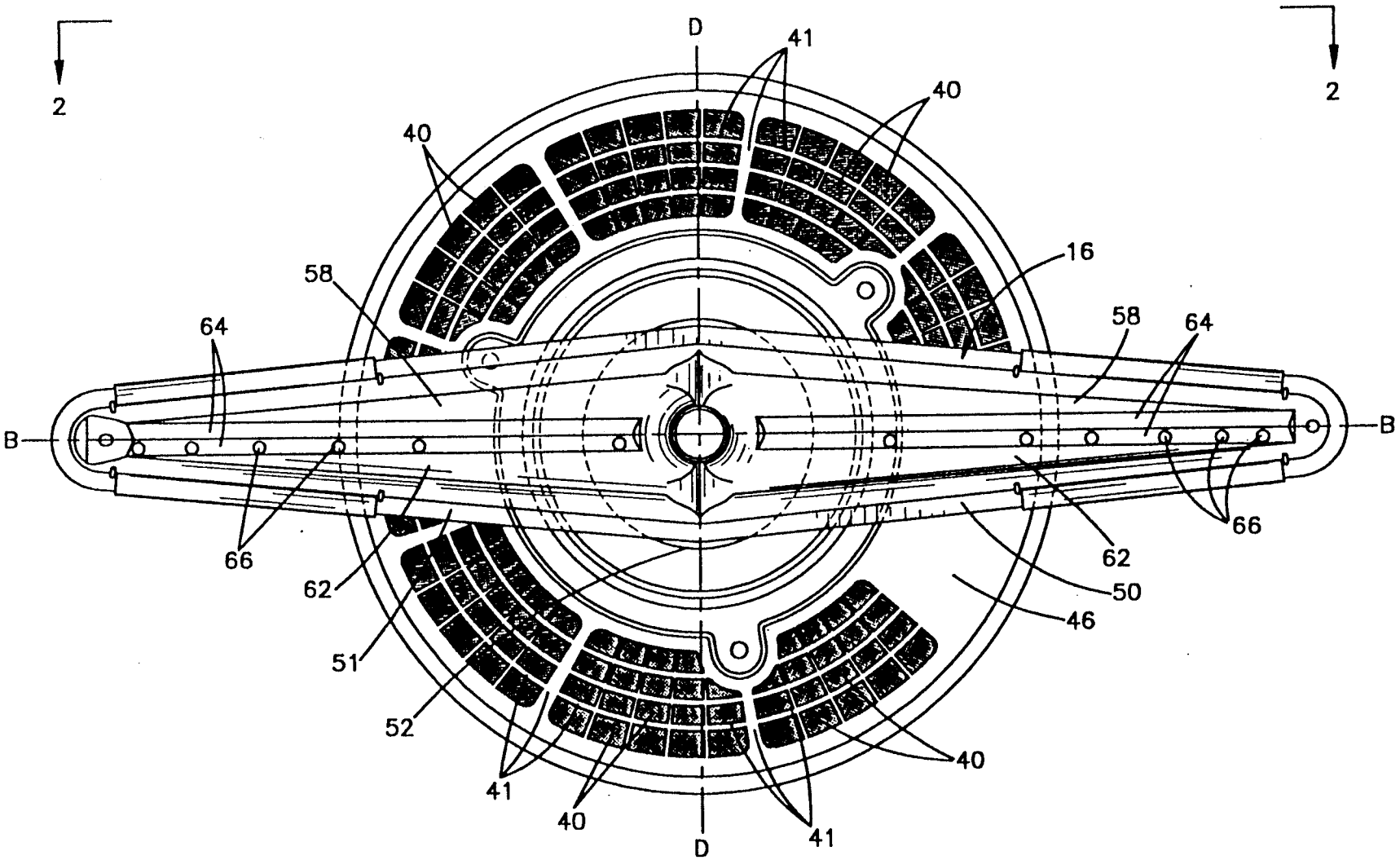
FIG. 1 is a top plan view of the wash arm and filter in accordance with the present invention.

With reference to the drawing figures, components of a dishwashing machine in accordance with the present invention are shown. The dishwashing machine generally includes a tub 10, a pump 12, a filter 14, and a wash arm 16. The tub 10, which includes means such as racks (not shown) to receive dishes, silverware, glasses, and the like, defines a sump 18 at a lower portion thereof. The pump 12, which is mounted to the tub 10 at a bottom of the sump 18, is powered by an electric motor 20, and is generally operable to pump wash water from the sump 18 through the wash arm 16 and filter 14 when operated in a recirculating mode, and to pump wash water from the filter 14 and sump 18 to drain (not shown) when operated in a drain mode.

Figure 2:
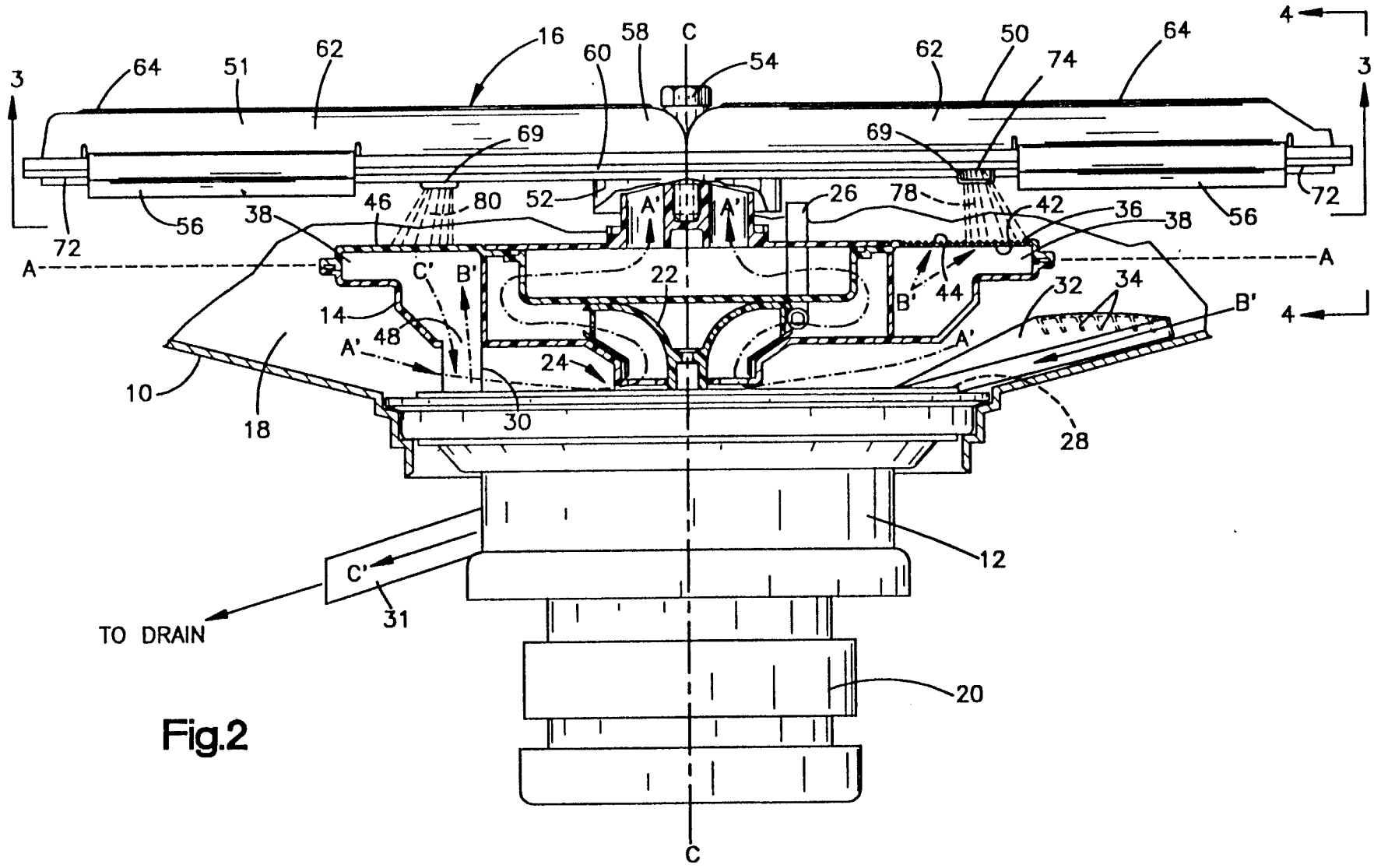
FIG. 2 is a front elevational view, partially in cross section, as viewed from lines 2—2 of FIG. 1.

The pump 12 includes an upper impeller 22 which draws water in from the sump 18 through an upper impeller inlet 24 and pumps it to the wash arm 16 when the pump 12 is operated in the recirculating mode (arrow A' in FIG. 2). When the pump 12 is reversed to operate in the drain mode, air is introduced into the upper impeller 22 via a stand pipe 26, generally disabling the upper impeller 22 (i.e., causing it to cavitate due to the introduction of air), thus minimizing the water being pumped into the wash arm 16.

Preferably, the pump 12 also provides a lower impeller (not shown) which draws wash water in from the sump 18 through a lower impeller inlet 28 when the pump 12 is operated in the recirculating mode. The wash water is thereafter pumped to the filter 14 via a channel or tube 30 (arrow B' in FIG. 2). When the pump is reversed to operate in a drain mode, the lower impeller pumps water from the filter 14 (arrow C' in FIG. 2) and from the sump 18 to drain via a drain conduit 31 and a drain hose (not shown). Preferably, the upper impeller 22 pumps between about fifty to sixty gallons per minute in the recirculation mode and a small or negligible amount in the drain mode. The lower impeller preferably pumps between about five to nine gallons per minute in the recirculation mode and between about four to six gallons per minute in the drain mode.

As shown in FIG. 2, the upper and lower impeller inlets 24 and 28 are separated by a separator plate 32, the upper impeller inlet 24 being above the separator plate 32 and the lower impeller inlet 28 being below the separator plate 32. The separator plate 32 includes a series of downwardly extending finger-like projections 34 which serve as a coarse filter to prevent large items such as silverware, large pieces of food, and the like from entering the lower impeller inlet 28.

The wash arm 16 of the present invention is capable of use with numerous types of pumps, the presently disclosed pump 12 merely being exemplary of the type of pump currently contemplated for use therewith- For example, a single impeller pump with a single or dual direction motor could be used and the pumped water split between the wash arm and the filter, with draining being controlled by appropriate valving. Also, a dual impeller pump with a unidirectional motor could be used wherein one impeller would supply water to the wash arm and the other impeller would supply water to the filter, with draining being controlled by appropriate valving (i.e., U.S. Pat. Nos. 4,346,723 and 4,468,333, the disclosures of which are expressly incorporated herein in their entirety). Alternatively, a dual impeller pump with a reversing motor, as in the disclosed pump, could be employed wherein one impeller would supply water to the wash arm and the other impeller would be operable to pump water through the filter, when in a recirculating mode, and drain the tub when in a drain mode (i.e., U.S. Pat. No. 4,392,891, the disclosure of which is expressly incorporated herein in its entirety).

The filter 14 includes a mesh portion 36 and a filtration chamber 38. The mesh portion 36 is provided to strain or filter debris or soil from wash water flowing therethrough. The filtration chamber 38, which is generally annular or ring-shaped, is provided and designed to retain filtered debris or soil therein when the pump 12 is operated in the recirculating mode. As mentioned earlier with regard to the operation of the pump, filtered debris or soil is flushed from the filtration chamber 38 to drain by the lower impeller when the pump 12 is operated in the drain mode.

The mesh portion 36 forms a substantial or major portion of the upper surface of the filtration chamber 38 and is immediately beneath the wash arm 16. Preferably, the mesh portion 36 is formed by integrally molding a lattice-type structure 41 around a series of small screens 40, the combination of the screens 40 and lattice 41 comprising a substantial portion of the upper surface of the filtration chamber 38 (FIG. 1). The mesh portion 36 includes inner and outer surfaces 42 and 44 and is preferably above the static level of water in the sump 18, which is identified by line A—A in FIG. 2. Preferably, the screens 40 are formed out of a mono-filament polyester fabric material having a thickness of about 0.011 inches, and the mesh size is about 0.010 inches. Naturally, the composition of the mesh screen material and the fabric and mesh sizes are merely illustrative, and the scope of the present invention is not limited thereto.

In addition to the mesh portion 36, the upper surface of the filtration chamber 38 includes an imperforate wall 46 which is generally in-line with an outlet 48 of the tube 30. As will be described more fully hereafter, water emanating from the tube 30 strikes, and is deflected by, the imperforate wall 46, allowing the filtration chamber 38 to fill and the wash water to disperse and flow more evenly through the screens 40 of the mesh portion 36. Thus, filtering of the wash water is distributed about a larger surface area (i.e., the entire mesh portion) than would otherwise occur.

The wash arm 16, which is preferably made out of plastic, comprises first and second oppositely directed arm portions 50, 51. The wash arm includes upper and lower members 58, 60. The lower member 60 provides a downwardly-directed cylindrical hub 52 which is mounted generally coaxial with the wash arm's vertical axis of rotation C—C via a mounting bolt 54. Each arm portion 50, 51 is also provided with a metal heat shield 56 which protects the wash arm 16 from overheating due to its proximity with a heating element (not shown).

Each arm portion 50, 51 of the upper member 58 has an upwardly stepped portion 62 which includes a pair of upwardly ramping surfaces 64 that intersect along the longitudinal center line B—B of the wash arm 16, as illustrated. The upwardly ramping surfaces 64 provide or define a series of upwardly and outwardly directed openings or wash jets 66 through which streams of dish-cleaning wash water project.

As shown best in FIG. 2, in the preferred embodiment the upwardly directed openings 66 are on a common side of the longitudinal center line B—B of the wash arm 16. Reaction forces created by water emanating from the upwardly directed openings 66 generally counteract or negate one another and do not rotatably drive the wash arm about its axis of rotation C—C.

Naturally, the scope of the present invention is not limited to the specific pattern, shape, or size of the upwardly directed openings or wash jets 66 described herein. Rather, it should be evident that any type or arrangement of openings or jets may be employed to supply sprays of wash water to the dishes within the tub 10.

The lower member 60 of the arm portions 50, 51 include a raised inner section 68 which is surrounded by a lower rim 70. The lower rim 70 includes an upstanding rib 75 (FIG. 5) which fits into a mating groove (not shown) in the upper member 58 to attach the upper and lower members and thereby form the wash arm 16. Preferably, ultrasonic welding or the like is used to fuse the upper and lower members 58, 60 and thereby create the hollow wash arm 16.

A step or shoulder surface 72 is formed at the intersection of the raised inner section 68 and the lower rim 70, as illustrated. First and second downwardly directed openings 74 and 76 are formed in the raised inner section 68 adjacent the shoulder surface 72. Preferably, the first opening 74 is spaced a first distance from a center line D—D of the wash arm 16, and the second opening 76 is spaced a second distance from the wash arm center line D—D.

In the illustrated preferred embodiment, the first and second openings 74, 76 are about 0.625 and 0.656 inches long, respectively. The first and second openings also preferably have a width of about 0.25 inches, and the first and second distances from the wash arm center line D—D are preferably about 3.828 and 3.25 inches, respectively. Hence, the first opening 74 is preferably smaller and spaced further from the wash arm center line D—D than the second opening 76.

The raised inner section 68 provides a pair of cover members 69, each of which surround or encircle a portion of one of the first and second openings 74 and 76. As such, the cover members serve 69 as directional spouts or jets, making the water flowing out of the first and second openings 74, 76 project outwardly and downwardly in a fan-like spray.

Figure 3:
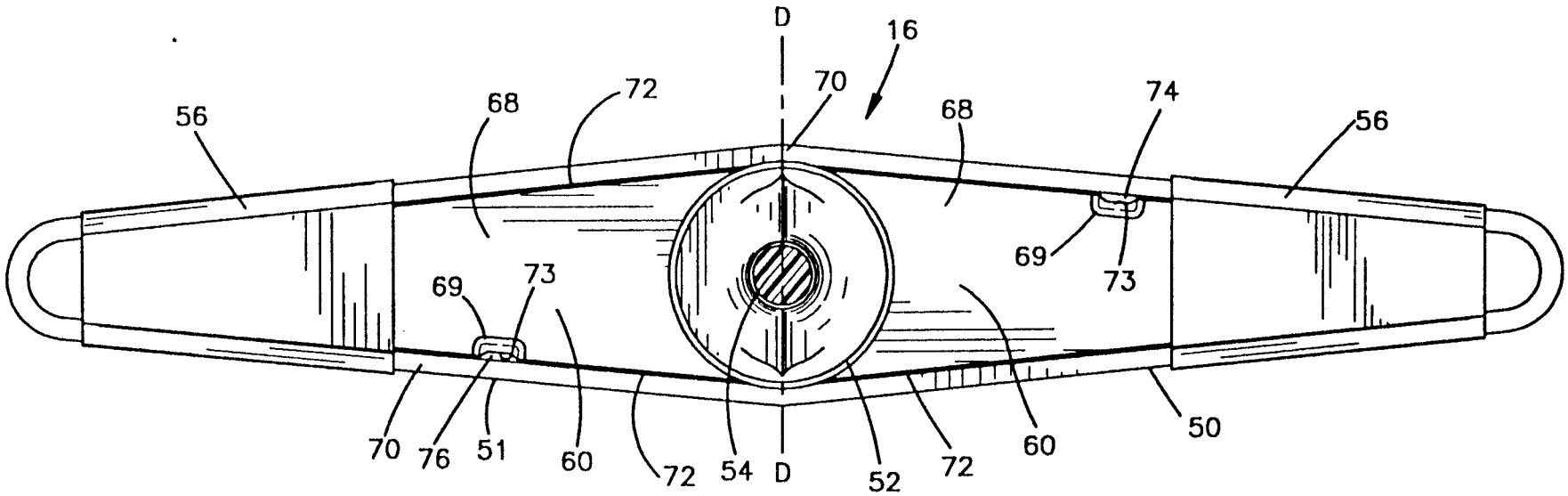
FIG. 3 is a bottom plan view of the wash arm of the present invention taken along lines 3—3 of FIG. 2.
Figure 5:
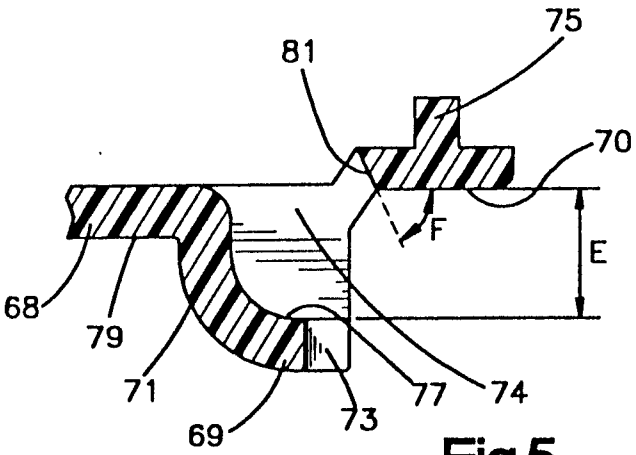

With reference to FIGS. 3 and 5, the cover members 69 are shown to include a rounded central body 71. The central body 71 includes a terminal surface 73 which defines a notched or recessed mid section, as shown best in FIG. 3. Preferably, an inner surface 77 of the rounded central body 71 is outwardly spaced from an outer surface 79 of the inner section 68 a distance E and, more preferably, the distance E is equal to about 0.160 inches. An inner edge 81 of the lower rim 70 forms one side of each of the openings 74, 76. Preferably, the inner edge 81 forms an angle F with respect to the rim 70, and, more preferably, the angle F is about 64°.

Figure 4:
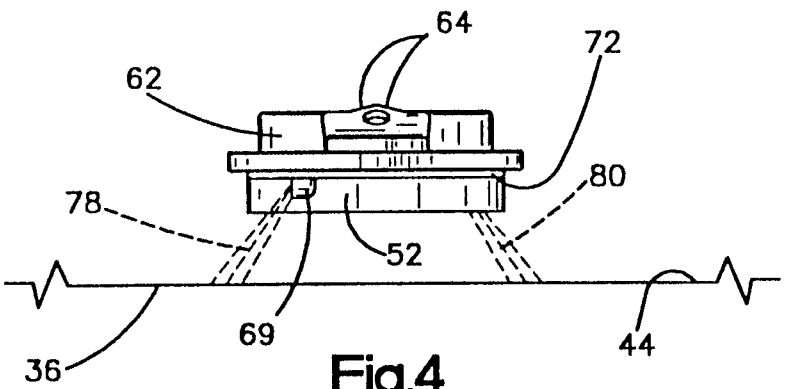
FIG. 4 is a side elevational view of the wash arm of the present invention as viewed from line 4—4 of FIG. 2, with a heat shield removed therefrom for clarity; and, FIG. 5 is a cross sectional view of an opening in a lower member of the wash arm of the present invention.

The cover members 69 and the inner edge 81 of the lower rim 70 cooperate to provide a flow directing jet structure which forces water emanating from the openings 74, 76 in the raised inner section 68 downwardly and outwardly (FIG. 4).

A first stream of water 78 exits the first opening 74 while a second stream of water 80 exits the second opening 76, as shown best in FIGS. 2 and 4. A first reaction force is created by the first stream of water 78 and tends to rotate the wash arm 16 counter-clockwise about its axis of rotation C—C. A second reaction force is created by the second stream of water 80 which also tends to rotate the wash arm 16 counter-clockwise about its axis of rotation C—C. The first and second reaction forces cooperate or combine to produce a relatively larger net reaction force which rotatably drives the wash arm 16 at a predetermined rate. Preferably, the predetermined rate is between twenty-four and thirty-six revolutions per minute and, more preferably, is between about twenty-eight and thirty-one revolutions per minute.

Each of the first and second streams 78 and 80 of wash water which, as shown best in FIG. 4, define a generally fan-like spray, strike or impinge upon the outer surface 44 of the mesh portion 36. The streams 78 and 80, which preferably overlap to ensure complete coverage of the mesh portion 36, flow through the screens 40 and rinse retained debris from the inner surface 42 of the mesh portion 36. Preferably, between about four to eight gallons per minute flow through each of the first and second openings 74 and 76. Since the outwardly-directed flow rate through the mesh portion 36 is between about five to nine gallons per minute and is dispersed over a large area, the localized or instantaneous effect of the first and second streams 78 and 80 is more than sufficient to overcome the outwardly-flowing filtered water. Naturally, the flows recited herein are merely provided by way of example and will vary depending upon pump discharge, wash arm size, opening sizes, and other variables. Therefore, the present invention is not limited to the flow rates specifically recited herein.

Operation of the wash arm 16 in accordance with the present invention will be described hereafter with reference to the foregoing description and drawings.

As briefly mentioned hereinbefore, when the pump 12 is operated in the recirculating mode, wash water is pumped by the lower impeller from the sump 18 to the filtration chamber 38 via the tube 30. The wash water enters the filtration chamber 38, strikes or impinges upon the imperforate wall 46, and fills the ring-shaped filtration chamber 38. As the filtration chamber fills, the heavier soil or debris in the wash water settles to the bottom of the chamber 38, where it remains until being flushed to drain when the pump 12 is operated in the drain mode.

When the filtration chamber 38 is full, wash water flows through the mesh portion 36 from the inner surface 42 to the outer surface 44 thereof. Soil or debris is filtered or strained from the wash water flowing through the mesh portion 36 and is retained on the inner surface 42 of the mesh portion while the heavier debris or soil settles to the bottom of the chamber 38. Since the mesh portion 36 is above the static level of water A—A in the sump 18, filtered water flows off or over the filter 14 and back into the sump 18.

Simultaneously, wash water is pumped by the upper impeller 22 into the wash arm 16. Streams of wash water project or emanate from the upwardly directed openings 66 and impinge upon and thus clean the dishes within the tub 10. Also, the first and second outwardly and downwardly directed streams of wash water 78 and 80 project or emanate from the first and second downwardly directed openings 74 and 76, simultaneously driving the wash arm 16 counter-clockwise about its axis of rotation C—C and impinging upon the mesh portion 36 of the filter, in effect back-flushing or rinsing retained or entrapped debris from the inner surface 42 of the mesh portion. The back-flushed or rinsed debris or soil is thereafter held and suspended within the filtration chamber 38 until the pump 12 is reversed to operate in the drain mode.

When the pump 12 is operated in the drain mode (in this case reversing the rotation of the pump impellers), air is drawn into the upper impeller 22 via the stand pipe 26, generally disabling the upper impeller 22 and substantially preventing the further supply of wash water to the wash arm 16. However, due to angular momentum and the water remaining within the wash arm, the wash arm 16 continues to rotate for a brief time and supply a final rinsing spray to the filter 14. The lower impeller pumps or flushes filtered and settled soil or debris from the filtration chamber 38 to drain via the tube 30 and the drain conduit 31. Simultaneously, the lower impeller pumps wash water from the sump 18 to drain via the drain conduit 31, thereby emptying water from the tub 10.

While the preferred embodiment of the present invention is shown and described herein, it is to be understood that the same is not so limited but shall cover and include any and all modifications thereof which fall within the purview of the invention. For example, it should be clear that any location, size, or shape of downwardly directed opening in the wash arm can be used without exceeding the scope of the invention as defined hereinafter, it merely being important that the streams of wash water emanating therefrom simultaneously propel the wash arm and rinse or back flush the filter. Moreover, it is contemplated that the first and second downwardly directed openings 74 and 76 could be of sizes different than those recited herein and/or located on the same arm portion 50 or 51 (i.e., on the same side of the hub 52). It is also contemplated that a single downwardly directed opening could be used to simultaneously provide the wash arm propelling and filter rinsing functions.

What is claimed is:

1. A dishwasher comprising:

a tub adapted to receive dishes to be washed and providing a sump to temporarily retain a quantity of wash water;

pump means for circulating wash water from said sump throughout the tub;

means for filtering debris from said wash water; and, a rotatably mounted wash arm having a generally vertical axis of rotation and first and second oppositely directed arm portions with a common center line, said wash arm being generally hollow and receiving a portion of the wash water circulated by the pump means, said wash arm including at least one downwardly directed opening which is laterally spaced from the center line of the wash arm and adapted to spray at least one stream of wash water onto the filter means to rinse debris therefrom, said at least one stream creating a reaction force which rotatably drives the wash arm about its axis of rotation.

2. A dishwasher according to claim 1, wherein the wash arm includes first and second downwardly directed openings which are laterally spaced from the center line of the wash arm, said first opening being spaced a first distance from a center of the wash arm and the second opening being spaced a second distance from the center of the wash arm.

3. A dishwasher according to claim 2, wherein the wash arm further comprises a flow-directing means, said flow-directing means at least partially encircling said first and second openings and being operable to transform the water emanating therefrom into a downwardly and outwardly-directed spray.

4. A dishwasher according to claim 3, wherein the filter means comprises a settling chamber and a mesh screen, said mesh screen defining a generally horizontal plane which underlies the wash arm, said mesh screen defining at least a portion of an upper surface of the settling chamber.

5. A dishwasher according to claim 4, wherein the mesh screen comprises inner and outer surfaces, said inner surface having filtered debris retained thereon and said outer surface being impinged upon by said first and second streams of wash water, said first and second streams of wash water being operable to rinse filtered debris from said inner surface of said filter, said rinsed debris thereafter being temporarily contained within said settling chamber.

6. A dishwasher comprising:

a tub adapted to receive dishes to be washed and providing a sump to temporarily retain a quantity of wash water;

pump means for circulating wash water from said sump throughout the tub;

filter means for filtering debris from said wash water, said first filter means comprising a mesh screen having inner and outer surfaces, wash water from said pump means flowing through the mesh screen from the inner surface to the outer surface such that said mesh screen removes debris from said wash water and retains said debris on the inner surface thereof; and, a rotatably mounted wash arm having a generally central axis of rotation and first and second oppositely directed arm portions with a common center line, said wash arm receiving wash water from said pump means and including dish washing means and combined wash arm propelling and filter rinsing means, said dish washing means comprising a plurality of upwardly directed openings, said upwardly directed openings being adapted to spray wash water onto the dishes within the tub, said propelling and rinsing means comprising first and second downwardly directed openings, said first and second openings being located on opposite sides of the wash arm center line and adapted to spray first and second streams of wash water onto the outer surface of the filter, wherein said first and second streams of wash water cooperate to simultaneously rotatably drive the wash arm about its axis of rotation and rinse retained debris from the inner surface of the filter.

7. A dishwasher according to claim 6, wherein the first opening is spaced a first distance from a center of the wash arm and the second opening is spaced a second distance from the center of the wash arm.

8. A dishwasher according to claim 7, wherein the filter means further comprises a settling chamber, said mesh screen defining at least a portion of the settling chamber.

9. A dishwasher according to claim 8, wherein said pump means comprises a dual impeller reversible pump having first and second impeller means, said first impeller means being operable to pump wash water from said sump to said wash arm when the pump is in a wash mode and being generally disabled when the pump is in a drain mode, said second impeller means being operable to pump wash water from said sump to said filter means when the pump is operated in the wash mode and being operable to pump water from said sump and said filter to drain when the pump is operated in the drain mode.

10. A wash arm for a domestic dishwashing machine, said wash arm comprising:

first and second arm portions, said arm portions being oppositely directed and having a common center line;

an uppermost member defining a series of washing jets, said washing jets being adapted to direct upwardly a series of dish-cleaning sprays;

a lower member comprising a first downwardly directed opening, said first opening being located on a first side of said center line and at least partially covered by a first cover member, said first cover member being adapted to transform a downwardly directed flow of wash water emanating from said first opening into a first downwardly and outwardly directed stream of wash water.

11. A wash arm according to claim 10, wherein the lower member comprises a second downwardly directed opening, said second downwardly directed opening being located on a second side of said center line and at least partially covered by a second cover member, said second cover member being adapted to transform a downwardly directed flow of wash water emanating from said second opening into a second downwardly and outwardly directed stream of wash water.

12. A wash arm according to claim 11, wherein the first opening is a first distance from a center of the wash arm and the second opening is a second distance from the center of the wash arm.

13. A wash arm according to claim 12, wherein the first opening is formed in the first arm portion and the second opening is in the second arm portion.

14. A wash arm according to claim 13, wherein the lower member further comprises a raised inner section which is surrounded by a lower rim, said first and second openings being formed in the raised inner section adjacent the lower rim.

15. A wash arm according to claim 14, wherein the cover means are integrally provided by the raised inner section and include rounded cover members, said rounded cover members generally covering a substantial portion of the first and second openings and causing wash water emanating therefrom to be outwardly and downwardly directed.

16. A wash arm according to claim 14, wherein the wash arm defines a generally vertical axis of rotation, said first and second downwardly and outwardly directed streams of wash water being provided to simultaneously rotatably propel the wash arm about the vertical axis of rotation and rinse debris from a filter.

17. A wash arm according to claim 11, wherein the wash arm defines a generally vertical axis of rotation, said first and second downwardly and outwardly directed streams of wash water being provided to simultaneously rotatably propel the wash arm about the vertical axis of rotation and rinse debris from a filter.

18. A wash arm according to claim 11, wherein the first and second cover means are integral with the lower member.

19. A wash arm according to claim 18, wherein the first and second cover means include rounded cover members, said rounded cover members generally covering a substantial portion of the first and second openings and causing wash water emanating therefrom to be outwardly and downwardly directed.

20. A wash arm according to claim 19, wherein the wash arm defines a generally vertical axis of rotation, said first and second downwardly and outwardly directed streams of wash water being provided to simultaneously rotatably propel the wash arm about the vertical axis of rotation and rinse debris from a filter.

* * * * *

UNITED STATES PATENT AND TRADEMARK OFFICE

CERTIFICATE OF CORRECTION

PATENT NO. : 5,333,631

DATED : August 2, 1994

INVENTOR(S) : Daniel R. Kirkland et al.

It is certified that error appears in the above-identified patent and that said Letters Patent is hereby corrected as shown below:

Column 8, line 4, (Claim 6, line 8), delete "first".

Column 8, line 56, (Claim 10, line 6), delete "uppermost" and insert --upper--.

Signed and Sealed this

Thirteenth Day of December, 1994

*Attest:*

Bruce Lehman

BRUCE LEHMAN

*Attesting Officer*

*Commissioner of Patents and Trademarks*